US009307841B2

(12) United States Patent
Jamele et al.

(10) Patent No.: US 9,307,841 B2
(45) Date of Patent: Apr. 12, 2016

(54) SYSTEMS AND METHODS FOR FLUID DELIVERY IN SEAT SYSTEMS

(71) Applicant: MediaMation, Inc., Torrance, CA (US)

(72) Inventors: Daniel Robert Jamele, Redondo Beach, CA (US); Takayoshi Kawakami, Tustin, CA (US); Jordan Wolf Ryle, Los Angeles, CA (US); Ryan Adam Boda, Torrance, CA (US)

(73) Assignee: MediaMation, Inc., Torrance, CA (US)

( * ) Notice: Subject to any disclaimer, the term of this patent is extended or adjusted under 35 U.S.C. 154(b) by 0 days.

(21) Appl. No.: 14/484,196

(22) Filed: Sep. 11, 2014

(65) Prior Publication Data

US 2016/0073787 A1 Mar. 17, 2016

(51) Int. Cl.

| | |
|---|---|
| ***A63G 31/16*** | (2006.01) |
| ***B05B 12/02*** | (2006.01) |
| ***A47C 7/62*** | (2006.01) |
| ***A47C 7/54*** | (2006.01) |
| ***B05B 1/00*** | (2006.01) |
| ***A63G 31/00*** | (2006.01) |

(52) U.S. Cl.

CPC ... *A47C 7/62* (2013.01); *A47C 7/54* (2013.01); *A63G 31/00* (2013.01); *B05B 1/00* (2013.01); *B05B 1/005* (2013.01); *B05B 12/02* (2013.01)

(58) Field of Classification Search

CPC ..... A63G 31/00; A63G 31/16; A47C 1/00; A47C 15/00; A47C 15/004; A47C 7/68

USPC ..... 472/59–60, 130, 137; 434/55

See application file for complete search history.

(56) References Cited

U.S. PATENT DOCUMENTS

| | | | | |
|---|---|---|---|---|
| 2,562,959 | A | 8/1951 | Stern | |
| 2,905,049 | A | 9/1959 | Laube | |
| 3,628,829 | A | 12/1971 | Heilig | |
| 4,431,183 | A | 2/1984 | Reimann | |
| 5,807,177 | A * | 9/1998 | Takemoto | A47C 7/72 273/148 B |
| 5,832,320 | A | 11/1998 | Wittek | |
| 5,913,568 | A | 6/1999 | Brightbill et al. | |
| 6,152,829 | A | 11/2000 | Jaidka | |

(Continued)

FOREIGN PATENT DOCUMENTS

| | | | |
|---|---|---|---|
| EP | 0106786 | A1 | 4/1984 |
| EP | 2623172 | A1 | 8/2013 |
| WO | WO 2013/115477 | A1 | 8/2013 |

OTHER PUBLICATIONS

PCT/US2015/043850 International Search Report mailed on Jan. 7, 2016.

(Continued)

*Primary Examiner* — Kien Nguyen
(74) *Attorney, Agent, or Firm* — Robert Moll

(57) ABSTRACT

The present invention relates to systems and methods of delivering fluid from one or more armrests of seat systems. In a feature, the system includes a seat support assembly with armrests with one or more fluid nozzles mounted on one or more of the armrests, a fluid delivery system coupled to the one or more fluid nozzle(s), wherein the fluid nozzles are mounted on an end of the armrest that slopes upward to direct fluid toward the viewer. In another feature, the system includes a controller (e.g., a network server) configured to communicate on and off commands that correspond to events on a timeline of a movie to actuate the fluid delivery system to deliver fluids to the nozzles.

23 Claims, 7 Drawing Sheets

(56) References Cited

U.S. PATENT DOCUMENTS

| | | | | |
|---|---|---|---|---|
| 6,224,491 | B1 * | 5/2001 | Hiromi | A63G 31/007 297/180.1 |
| RE40,591 | E | 12/2008 | Denyer | |
| 7,691,002 | B2 * | 4/2010 | Casey | A63G 4/00 472/55 |
| 7,934,773 | B2 | 5/2011 | Boulais et al. | |
| 7,971,805 | B2 | 7/2011 | Nolte et al. | |
| 8,827,709 | B1 | 9/2014 | Gurule et al. | |
| 2006/0113400 | A1 | 6/2006 | Dodson | |
| 2007/0138660 | A1 | 6/2007 | Guo | |
| 2007/0278331 | A1 | 12/2007 | Hansson | |
| 2014/0030974 | A1 | 1/2014 | D'Angelo et al. | |

OTHER PUBLICATIONS

PCT/US2015/043850 Written Opinion of International Searching Authority mailed on Jan. 7, 2016.

* cited by examiner

SYSTEMS AND METHODS FOR FLUID DELIVERY IN SEAT SYSTEMS

BACKGROUND

The present invention relates to systems and methods of fluid delivery for effects for a viewer in a seat system.

Disney's Star Tours and Universal Studio's The Simpsons Ride, commercial movie theaters, gaming environments, and training centers (e.g., military, law enforcement, and flight schools) use effects to produce the sensation that one is immersed in the reality displayed on a movie screen.

A motion effect is implemented by synchronizing the seat motion of the viewer to correspond to the displayed scenes. The motion seat systems can be adapted to receive motion signals that move seats to correspond (e.g., synchronize) to other signals (e.g., video and/or audio signals) that are perceived by person(s). For example, the seat system may synchronize seat motions with the displayed motions in a theater to simulate the forces one would experience seated in a vehicle in a chase scene where the vehicle races around a city street.

Another effect is to deliver fluids such as a water mist, a blast of air, wind, and one or more scents to the viewer with the displayed scenes. For example, a system may deliver an orange scent to the viewer while movie displays a character traveling through an orange orchard, deliver a water mist to the viewer when the character travels through a rainy jungle or wind in a storm scene. To the inventors' awareness, the wind effect is implemented by fans hanging in a theater, but this may distract from the viewer's experience and may be noisy. The water mist and scents have been implemented by installing nozzles in a front rail in front of a row of seats or installing the nozzles into the back of the seats in front of the viewers, but either approach is expensive to implement and not practical because the motion of the seats affects the directionality of the fluid delivery. In short, the motion seats may move the viewer out of the path of fluid delivery.

SUMMARY OF THE INVENTION

The present invention relates to systems and methods of fluid delivery for effects for a viewer in a seat system.

In a feature, the system includes a seat support assembly, one or more seats on the seat support assembly, including one or more armrests, an air nozzle on one of the armrests, and a fluid delivery system including a controllable valve array including an air inlet, a high flow air outlet, a low flow air outlet, a first scent outlet, a high flow air line connected from the high flow air outlet through a high flow air regulator to a first fluid line, a low flow air line connected from the low flow air outlet through a low flow air regulator to the first fluid line, and a first scent line connected from the first scent outlet through a first scent flow regulator and a first scent tank to the first fluid line, wherein the first fluid line is coupled to the air nozzle.

In another feature, the valve array further includes a second scent outlet, wherein a second scent line is connected from the second scent outlet through a second scent flow regulator and a second scent tank to the first fluid line coupled to the air nozzle.

In another feature, the system further includes a water nozzle on the one of the armrests, and a water valve with a water inlet and a water outlet, wherein a water line is connected from the water outlet to a second fluid line coupled to the water nozzle.

In still another feature, the valve array further includes an atomizing air outlet, an atomizing air line connected from the atomizing air outlet through an atomizing air flow regulator to the water nozzle, wherein the water nozzle is adapted to deliver atomized water when the valve for the atomizing air outlet and the water valve are open.

In yet another feature, a controller is configured to communicate on and off commands that correspond to events on a timeline of a movie to actuate one or more of the valves of the valve array to deliver fluids to the nozzles.

In still another, the system further includes a shut-off valve on the water line downstream from the water valve.

In another embodiment, the system includes a seat support assembly, one or more seats on the seat support assembly, including one or more armrests, and one or more fluid nozzles mounted on the one or more armrests, a fluid delivery system, including an air inlet, a high flow air outlet, a high flow air line connected from the high flow air outlet through a high flow air regulator to a first fluid line, a low flow air outlet, a low flow air line connected from the low flow air outlet, through a low flow air regulator, to the first fluid line coupled to the air nozzle.

In another feature, the system further includes a shut off valve on the water line downstream from the water valve.

In an additional feature, the air flow regulators can be replaced by pressure regulators. In still another feature, the flow regulators and/or the pressure regulators can be omitted. In yet another feature, the air flow regulators or the pressure regulators, can be positioned anywhere along their respective air lines or can be positioned upstream from the air inlet.

In another feature, the system includes a controller configured to communicate on and off commands that correspond to events on a timeline of a movie to actuate one or more of the valves of the valve array to deliver fluids to the nozzles.

In a feature, the method of fluid delivery to a viewer in a seat system includes providing nozzles, on seat armrests, coupled to a fluid delivery system, and communicating commands from a controller, wherein the commands are associated with events on a movie timeline, adapted to actuate the fluid delivery system to deliver fluids to the nozzles.

DETAILED DESCRIPTION OF THE PREFERRED EMBODIMENTS

The following description includes the best mode of carrying out the invention. The detailed description is made for the purpose of illustrating the general principles of the invention and should not be taken in a limiting sense. The scope of the invention is determined by reference to the claims. Each part is assigned its own part number throughout the specification and drawings.

Figure 1:
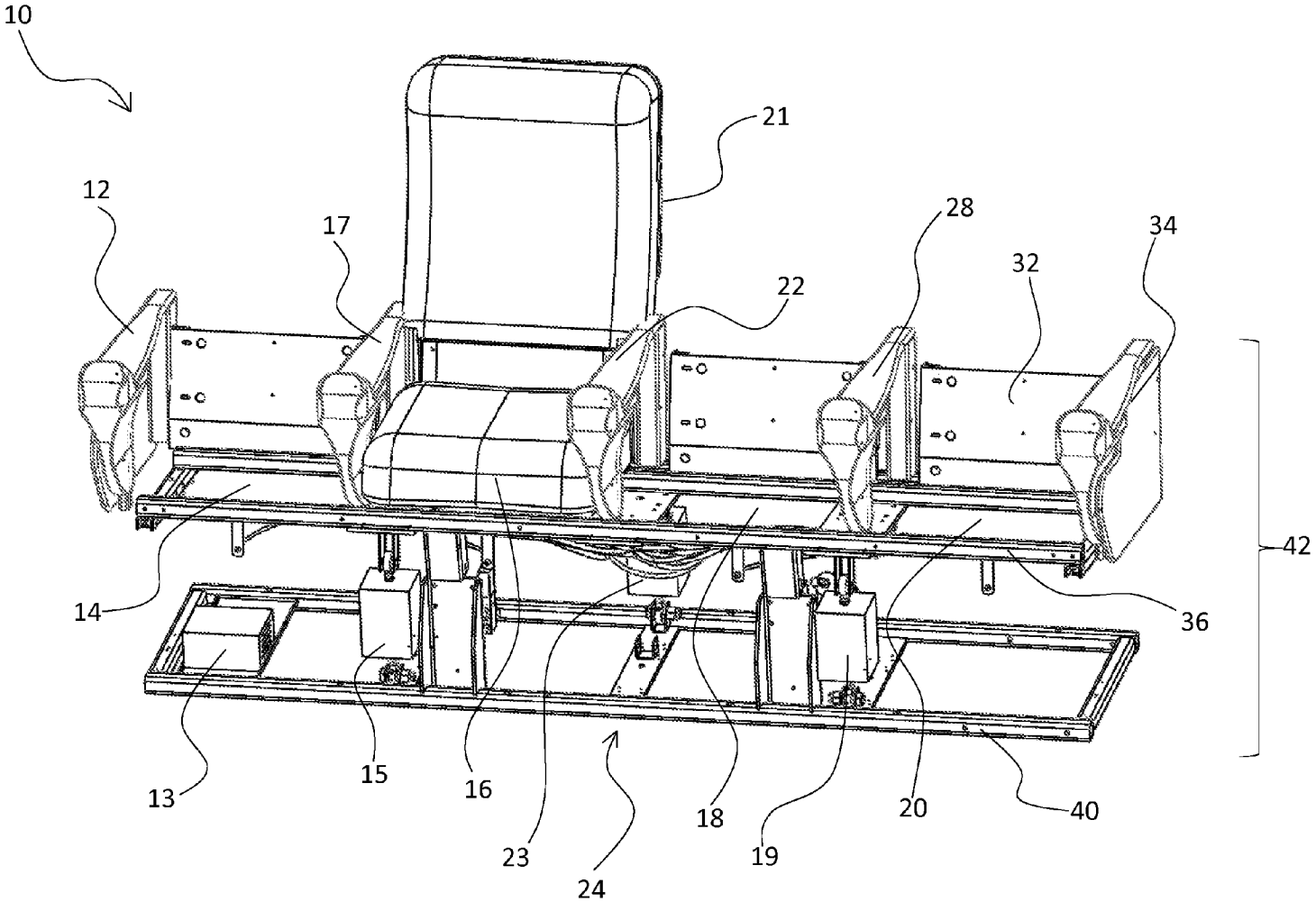
FIG. 1 illustrates a seat support assembly that is useful for the system.

FIG. 1 illustrates a seat support assembly that is suitable for the system. In this embodiment, the system 10 includes a seat support assembly 42 that includes a top frame 36 and a bottom frame 40. Front actuators 15 and 19 and a back actuator 23 provide structural support between the top and bottom frames 36 and 40. The actuators also provide motion to the seat support assembly 42. U.S. Pat. No. 8,585,142 B2 to Jamele et al., Motion Seat Systems and Methods of Implementing Motion in Seats, which is incorporated by reference herein, describes motion seat systems that are suitable with the systems.

FIG. 1 also illustrates that in an embodiment a seat frame 32 is secured (e.g., bolted and welded) to the top frame 36. The seat frame 32 has four spaces 14, 16, 18, and 20 for the seats. Armrests 12, 17, 22, 28, and 34 are secured (e.g., bolted and welded) to the seat frame 32. A seat 21 in space 16 illustrates how the other seats (not shown) fit and are secured in spaces 14, 16, 18, and 20 on the seat support assembly 42.

Figure 5:
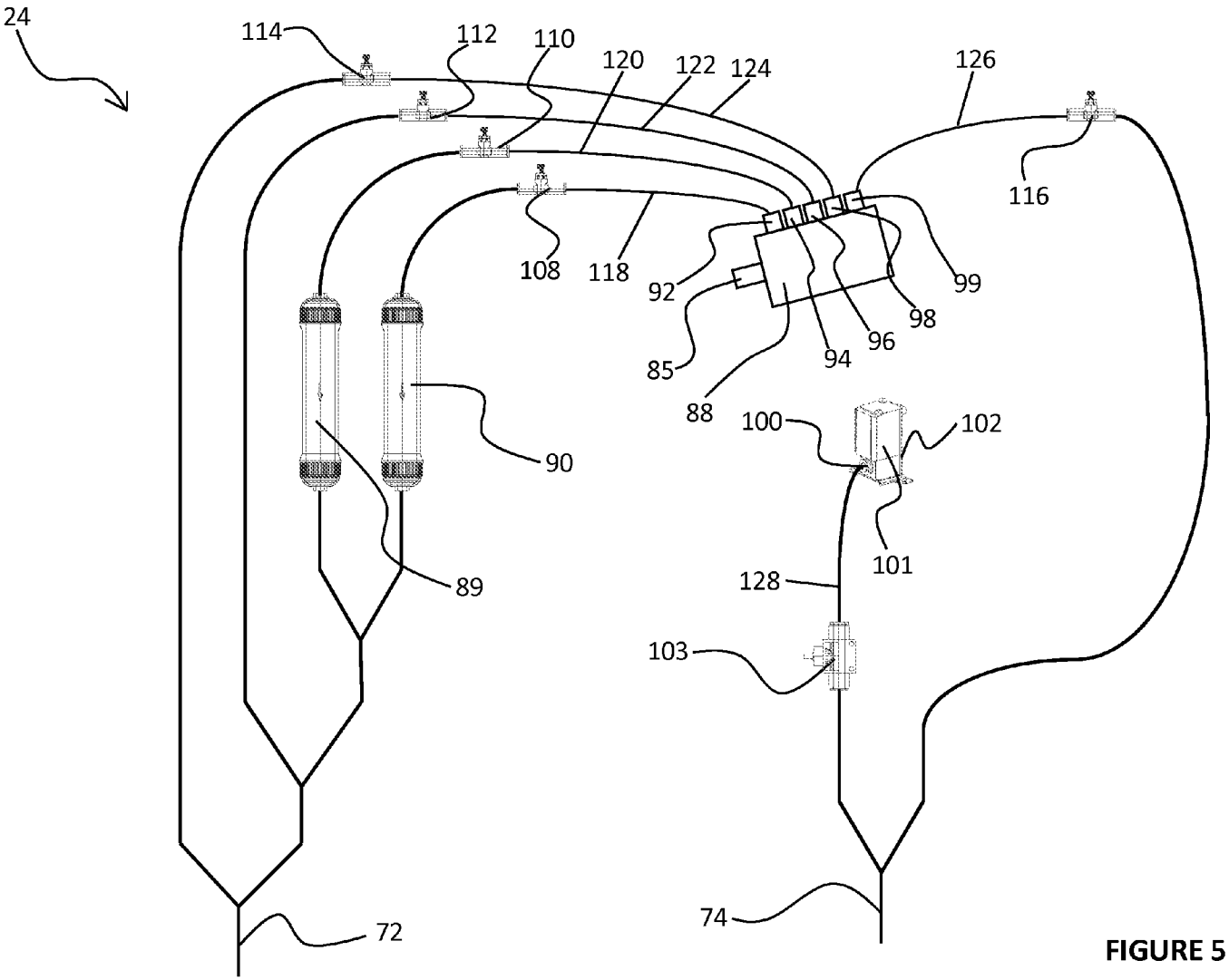
FIG. 5 illustrates an embodiment of the fluid delivery system used to distribute water, air, and/or scent(s) to the respective nozzles.
Figure 6:
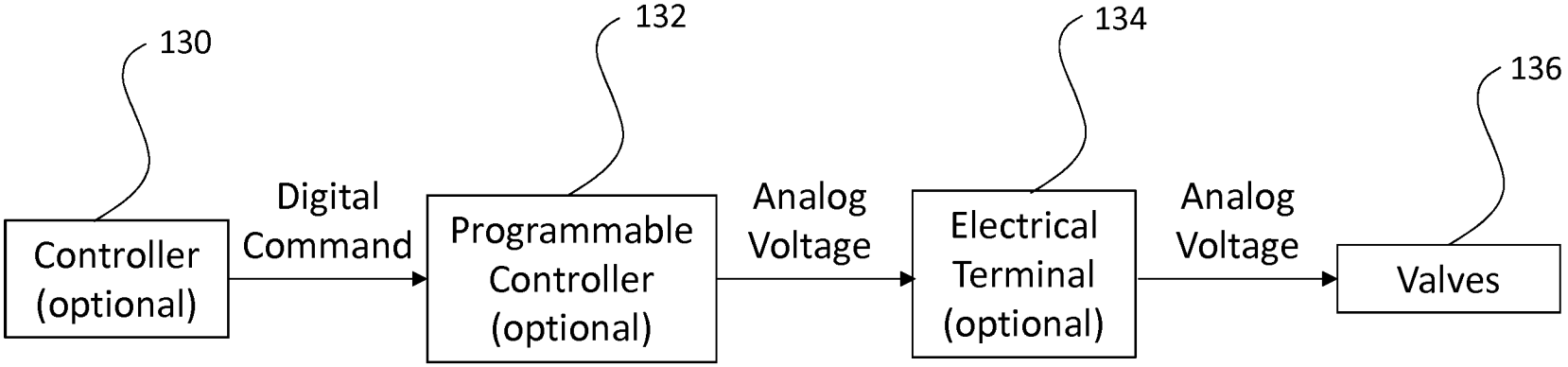
FIG. 6 illustrates a flowchart and hardware for control of the fluid delivery system.

In an embodiment, the seat support assembly 42 contains space for a fluid delivery system 24 (shown in FIG. 5) and a programmable controller 13. FIGS. 5-6 and the accompanying specification will describe both in detail.

Figure 2:
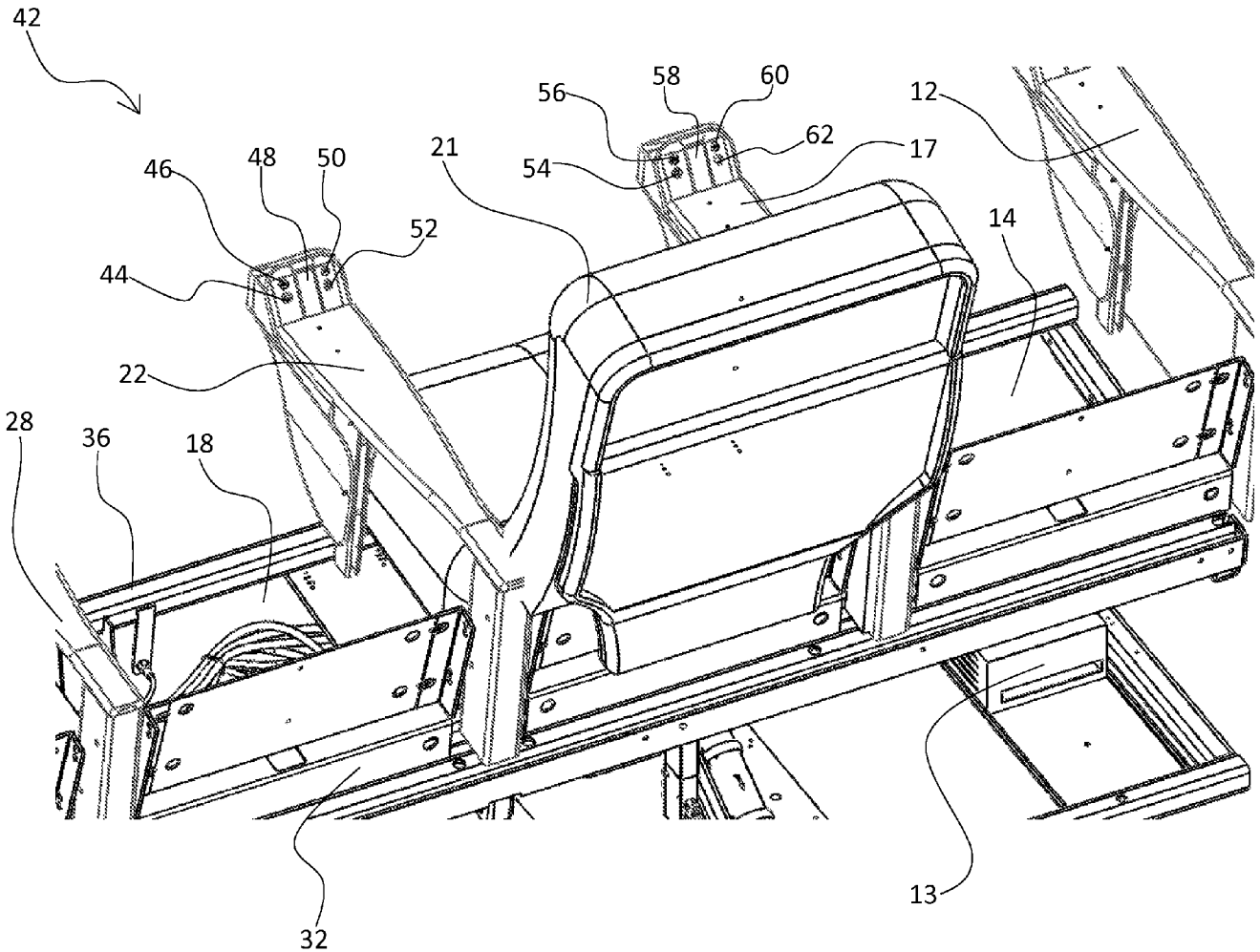
FIG. 2 illustrates a back view of the system of FIG. 1.

FIG. 2 illustrates a back side view of the system shown in FIG. 1. As shown, the armrest 22 includes a set of nozzles 44, 46, 50, and 52 that reside in holes in a sloped plate 48 at the end of armrest 22. The nozzles 50 and 52 will be used to distribute fluids such as air, water, and/or scents to a viewer in seat 21, while the nozzles 44 and 46 will be used to distribute fluids such as air, water, and/or scents to a viewer in a seat (not shown) that will occupy space 18. A suitable water nozzle is the Hago water nozzle MW5 that can be obtained from the Hago Manufacturing in Mountainside, N.J. A suitable air nozzle is the SMC muffler ASP-2 that can be obtained from SMC in Noblesville, Ind. This fluid distribution will be described in detail in connection with FIGS. 4A-5.

Similarly, the armrest 17 includes a set of nozzles 54, 56, 60, and 62 that reside in holes in a sloped plate 58 at the end of the armrest 17. The nozzles 54 and 56 will be used to distribute fluids such as air, water, and/or scents to a viewer in the seat 21, while the nozzles 60 and 62 will be used to distribute fluids such as air, water, and/or scents to a viewer in a seat (not shown) that will occupy space 14.

Figure 3:
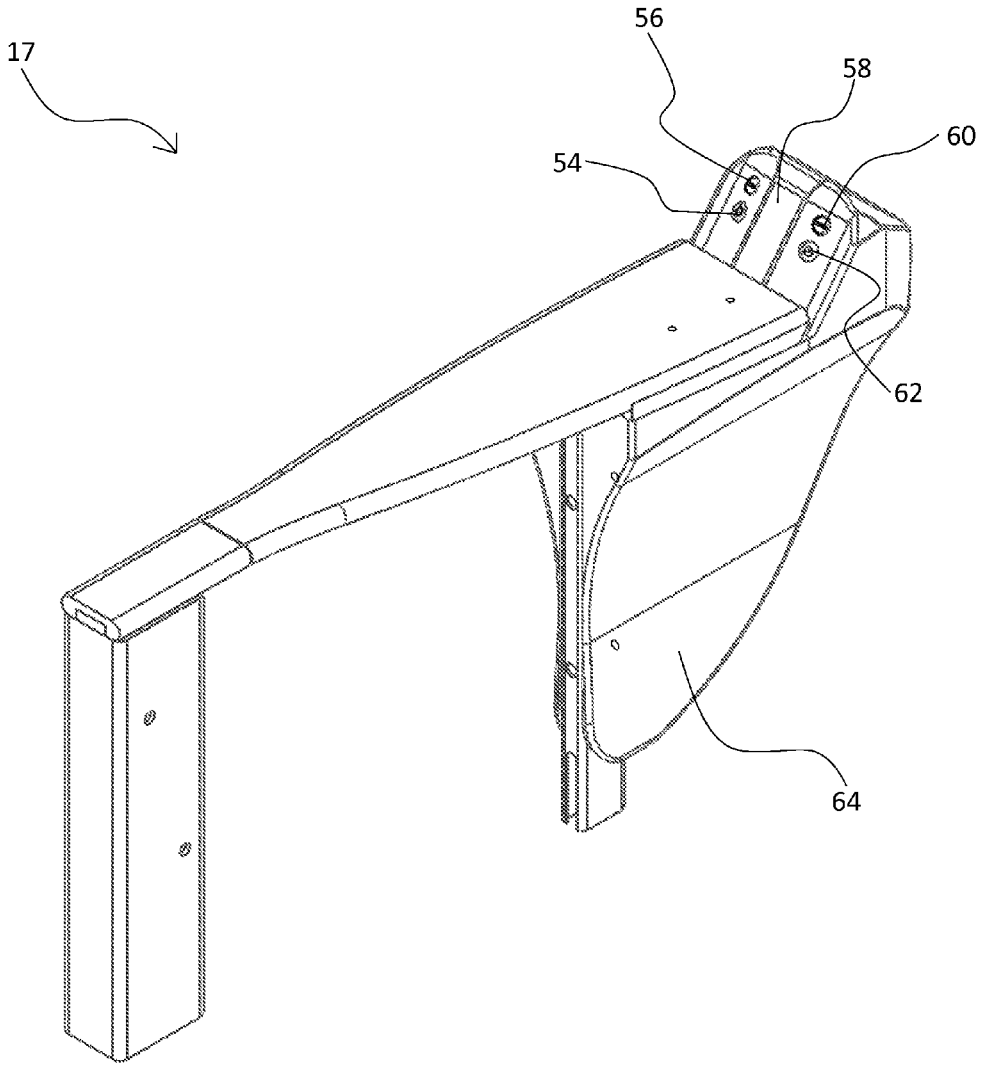
FIG. 3 is an external view of the armrest apart from the seat support assembly.

FIG. 3 is an external view of the armrest 17 apart from the seat support assembly 42 (FIGS. 1-2). A cover 64 adjacent to or integral with the nozzle plate 58 is a protective enclosure for the nozzles 54, 56, 60, and 62 and their respective fluid lines. A suitable fluid line is plastic tubing such as Festo PUN-6x1 plastic tubing from Festo in Esslingen am Neckar, Germany.

Figure 4A:
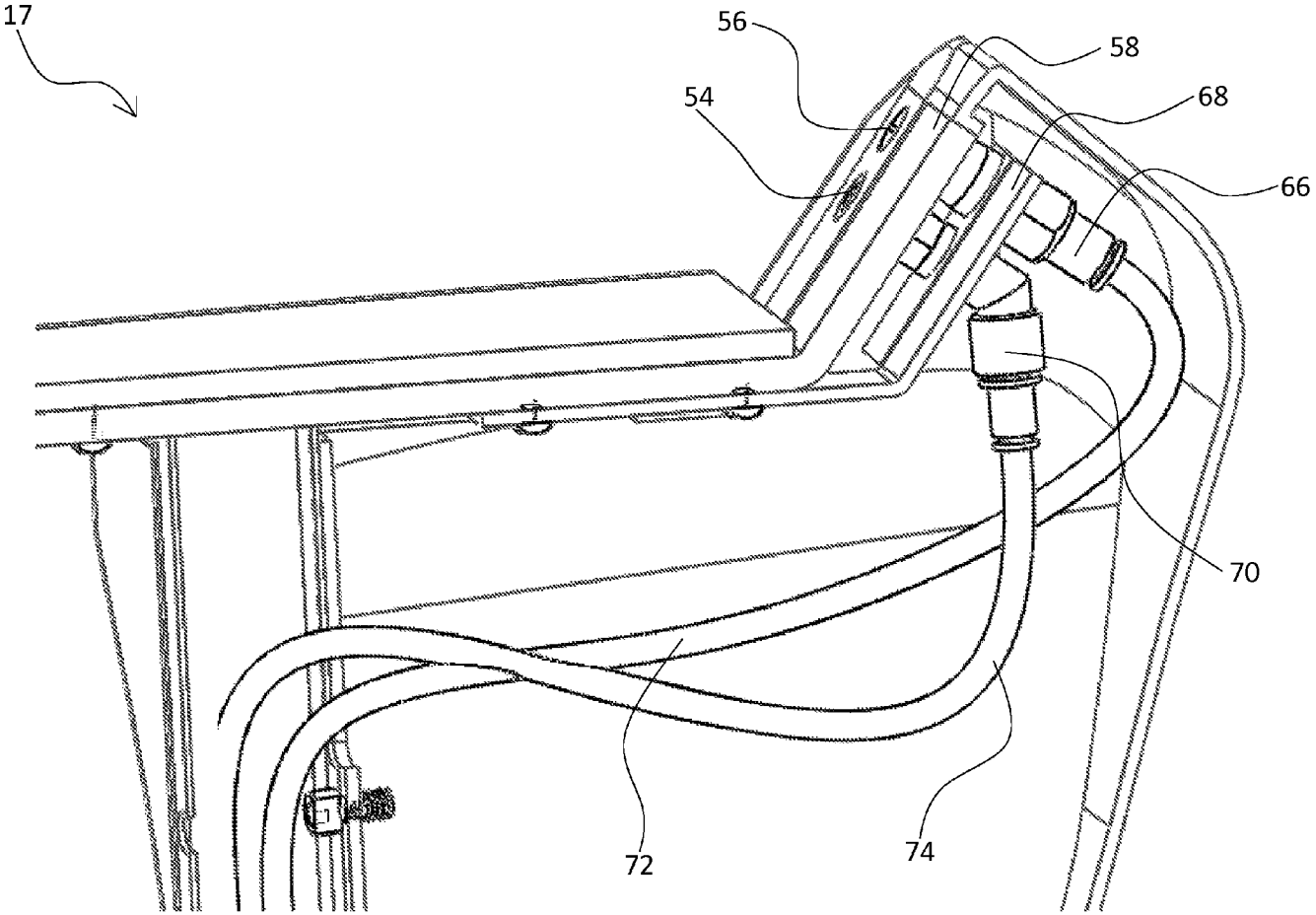
FIG. 4A is an internal view of the armrest that illustrates the nozzles and the nozzle plates.

FIG. 4A is an internal view of the armrest shown in FIG. 3. The cover 64 of armrest 17 is partly removed to reveal that the nozzles 54 and 56 residing in nozzle plate 58 are secured to the mounting plate 68 and coupled to nozzle fittings 66 and 70, which in turn are coupled to a first fluid line 72 and a second fluid line 74. A suitable water nozzle fitting is the SMC KQ2K06-01AS and a suitable air nozzle fitting is the SMC KQ2F07-35, both from SMC in Noblesville, Ind.

Figure 4B:
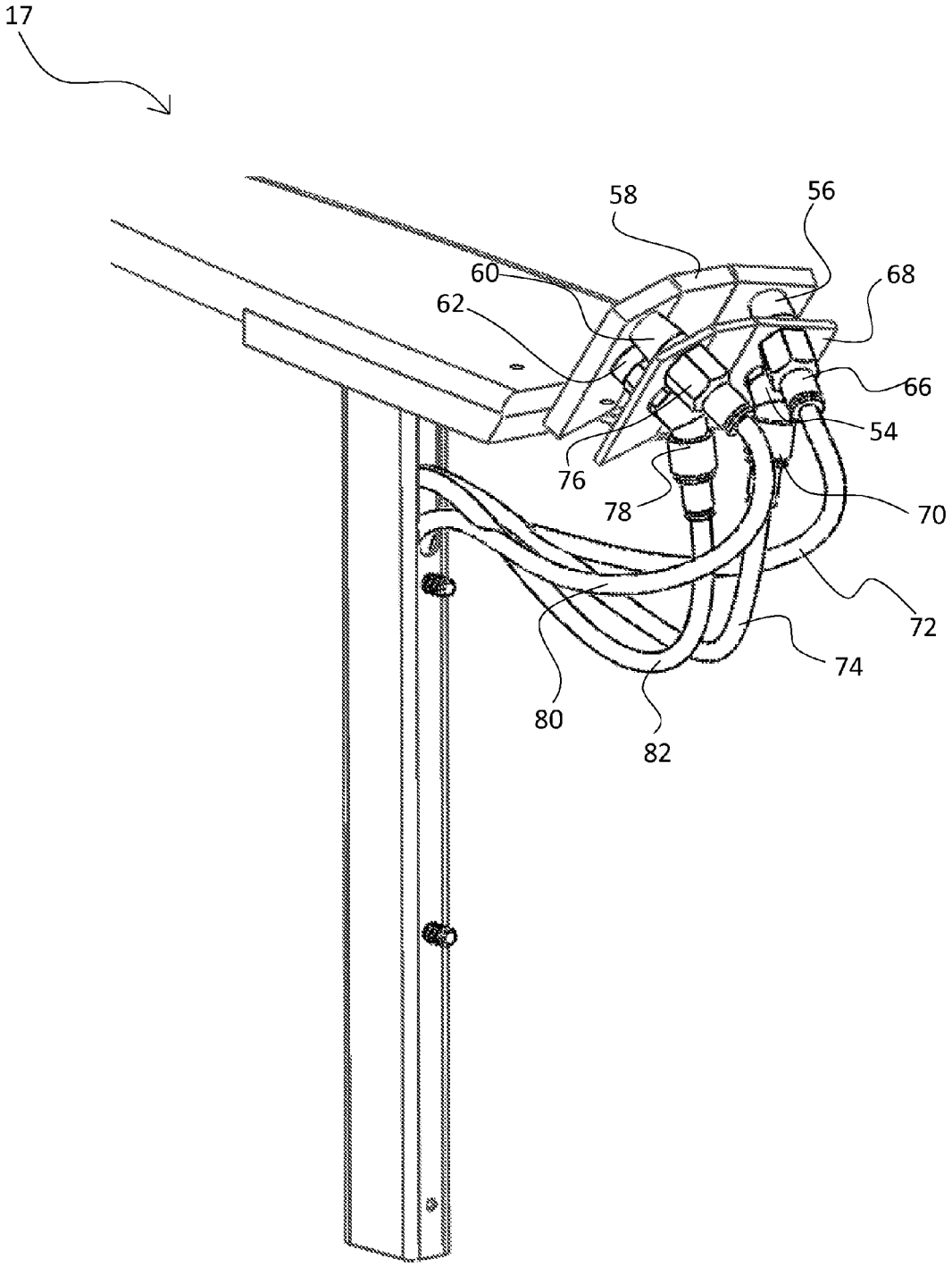
FIG. 4B is a view with the front cover of the armrest removed to show the nozzles secured to the plates.

FIG. 4B is an internal view of the components in the armrest. The front cover 64 is fully removed from armrest 17 to reveal that the nozzles 54, 56, 60 and 62 are secured to the mounting plate 68 and are coupled to the nozzle fittings 66, 70, 76, and 78, which in turn are coupled to the fluid lines 72, 74, 80, and 82.

FIG. 5 illustrates an embodiment of a fluid delivery system that can be used to distribute water, air, and scents to the nozzles shown in FIGS. 2-4B.

As illustrated, the fluid delivery system 24 includes a valve array 88. A suitable valve array can be assembled from Festo valve manifold VABM-L1-14S-G14-5 and Festo valves VUVG-L14-T32C-AT-G18-1P3, which can be obtained from Festo, Esslingen am Neckar, Germany. The valve array includes an air inlet 85, a high flow air outlet 98, a low flow air outlet 96, a first scent outlet 94, a second scent outlet 92, and/or an air outlet 99.

An air supply source (not shown), e.g., an air compressor at 100 psi, supplies air to the air inlet 85. In an embodiment, a high flow air line 124 is connected from the air outlet 98 through a high flow air regulator 114 to the fluid line 72. A low flow air line 122 is connected from the air outlet 96 through a low flow air regulator 112 to the fluid line 72. A first scent line 120 is connected from the air outlet 94 through a first scent flow regulator 110 and a first scent tank 89 to the fluid line 72. A second scent line 118 is connected from the air outlet 92 through a second scent flow regulator 108 and a second scent tank 90 to the fluid line 72. As a result, the first fluid line 72 is able to deliver high air flow (e.g., air blast), a low air flow (e.g., wind), and scent(s)(e.g., freshly cut grass) through a single air nozzle 56 (FIG. 4B). A suitable flow regulator is the SMC AS2051FG-08 Inline Flow Control from SMC in Noblesville, Ind. A suitable scent tank is the Clear Inline DI Filter Cartridge 214 that can be obtained from Filter Direct in Santa Ana, Calif. A suitable scent source is the Scent Sleeve from Escential Resources FX from Torrance, Calif.

In additional embodiments, the air flow regulators 108, 110, 112, 114, and 116 can be replaced by pressure regulators. A suitable pressure regulator is the SMC AW30-N03-Z Filter Regulator from SMC in Noblesville, Ind. In another embodiment, the air flow regulators 108, 110, 112, 114 and/or 116 and/or the pressure regulators can be omitted. In other embodiments, the air flow regulators 108, 110, 112, 114, and 116, or the pressure regulators, can be positioned anywhere along their respective air lines 118, 120, 122, 124, and 126, or can be positioned upstream from the air inlet 85.

A water pump (not shown), e.g., 30-70 psi, supplies water to the water inlet 102 of the water valve 101, which couples the water line 128 from the water outlet 100, through a shut-off valve 103, to the fluid line 74. An atomizing air line 126 is coupled to the air outlet 99 and to an air flow regulator 116. The atomizing air line 126 is coupled to the fluid line 74. As a result, the fluid line 74 is able to deliver a fine spray of atomized water (e.g., mist) and/or water through a single water nozzle 56 (FIG. 4B). When the atomized water is delivered both the air outlet 99 and the water valve 101 are opened. A suitable water valve is the SMC water valve VDW22AA from SMC in Noblesville, Ind.

Many of the parts of the systems can be purchased and implemented with high strength steel, but the person of ordinary skill would readily understand the materials and parts to use after review of the specification. Further, the choice of materials and conventional parts is not essential to the invention.

FIG. 6 is a flowchart of the process and hardware transmitting commands from the controller to valves to control the fluid delivery system. In an embodiment, using known conventional techniques, the system can include a controller 130 that transmits a digital command to a programmable controller 132, which in turn transmits an analog voltage to an electrical terminal 134, which in turn sends the analog voltage to the valve array 88 (FIG. 5) and/or the water valve 101, collectively called valves 136, to actuate the valve(s). As indicated in FIG. 6, one or more of the hardware components 130, 132, and 134 can be omitted from the control process. In an alternative embodiment, an operator will manually actuate the valves 136 to achieve the desired effects.

FIGS. 1-6 illustrate the fluid delivery systems and methods of fluid delivery in a four-seat support assembly. However, the inventors recognize the fluid delivery system may be implemented for one or more seats, and each seat may include one or more armrests. Furthermore, the system may be implemented by an operator rather than a controller (e.g., a network computer), which is also referred to as a central controller. It is also recognized that the system is not limited to seating designed for commercial theaters, theme parks, exhibits, home theaters, and gaming. For example, it may be used in any environment where fluid effect will enhance or change the experience of the viewer in the seat.

Thus, the systems and methods described also eliminate the need for mounted fans to produce in-theater effects such wind. In addition, the system eliminates the need for rails mounted in front-row seats and water jets on the back of each additional row. Instead, the effects (e.g., air blasts, wind, water, mist and scents) are implemented at the armrest of the seat of the viewers. If the seat also moves, the effects move along with the viewer.

The design of the system allows unlimited configurations as to the number of seats, and also may provide each rider with the same experience at a relatively low cost.

What is claimed:

1. A system of fluid delivery for a seat system, comprising;

a seat support assembly;

one or more seats on the seat support assembly, including one or more armrests;

an air nozzle in an upwardly projected portion of one of the armrests to distribute fluid to a viewer on a seat of the seat support assembly; and a fluid delivery system including a controllable valve array including an air inlet, a high flow air outlet, a low flow air outlet, a first scent outlet, a high flow air line connected from the high flow air outlet through a high flow air regulator to a first fluid line, a low flow air line connected from the low flow air outlet through a low flow air regulator to the first fluid line, and a first scent line connected from the first scent outlet through a first scent flow regulator and a first scent tank to the first fluid line, wherein the first fluid line is coupled to the air nozzle.

2. The system of claim 1, wherein the valve array further includes a second scent outlet, wherein a second scent line is connected from the second scent outlet through a second scent flow regulator and a second scent tank to the first fluid line coupled to the air nozzle.

3. The system of claim 2, further comprising a water nozzle on one of the armrests, and a water valve with a water inlet and a water outlet, wherein a water line is connected from the water outlet to a second fluid line coupled to the water nozzle.

4. The system of claim 3, wherein the valve array further includes an atomizing air outlet, and an atomizing air line connected from the atomizing air outlet through an atomizing air flow regulator to the water nozzle, wherein the water nozzle is adapted to deliver atomized water when the valve for the atomizing air outlet and the water valve are open.

5. The system of claim 3, further comprising a shut-off valve on the water line downstream from the water valve.

6. The system of claim 1, further comprising a controller configured to communicate on and off commands that correspond to events on a timeline of a movie to actuate one or more of the valves of the valve array to deliver fluids to the nozzles.

7. The system of claim 1, further comprising an air compressor to supply pressurized air to the air inlet of the valve array.

8. The system of claim 1, further comprising a water pump to supply pressurized water to the water inlet.

9. A system for fluid delivery, comprising:

a seat support assembly;

one or more seats on the seat support assembly, including an armrest between the seats;

one or more fluid nozzles mounted on an end of the armrest that slopes upward to direct fluid toward a viewer on each of the seats; and a fluid delivery system, including a controllable valve array with an air inlet, a low flow air outlet, and a low flow air line connected from the low flow air outlet, through a low flow air regulator, to the first fluid line, wherein the first fluid line is coupled to the fluid nozzle on the armrest.

10. The system of claim 9, further comprising a high flow air outlet, and a high flow air line connected from the high flow air outlet through a high flow air regulator to a first fluid line.

11. The system of claim 10, further comprising a first scent line from a first scent air outlet through a first scent flow regulator and a first scent tank to the first fluid line.

12. The system of claim 11, further comprising a second scent line from a second scent air outlet through a second scent flow regulator and a second scent tank to the first fluid line.

13. The system of claim 10, wherein the low flow air line delivers a wind effect and the high flow air line delivers an air blast effect.

14. The system of claim 9, further comprising a controller that receives on and off commands and sends voltage signals to open and close one or more valves of the valve array.

15. The system of claim 14, wherein the controller is configured to communicate on and off commands that correspond to events on a timeline of a movie to actuate one or more of the valves of the valve array to deliver fluids to the nozzles.

16. The system of claim 9, wherein the fluid nozzle(s) are mounted to an end of the armrest that slopes upward to direct fluid toward the viewer's face, wherein the seats include a first seat and a second seat, wherein the fluid nozzle include a first fluid nozzle that directs fluid to a first viewer that would occupy the first seat and a second nozzle that directs fluid to a second viewer that would occupy the second seat.

17. The system of claim 9, further comprising a water nozzle on the armrest, and a water valve with a water inlet and a water outlet, wherein a water line is connected from the water outlet to a second fluid line coupled to the water nozzle.

18. The system of claim 17, wherein the valve array further includes an atomizing air outlet, and an atomizing air line connected from the atomizing air outlet through an atomizing air flow regulator to the water nozzle, wherein the water nozzle is adapted to deliver atomized water when the valve for the atomizing air outlet and the water valve are open.

19. The system of claim 17, further comprising a shut off valve on the water line downstream from the water valve.

20. A method of fluid delivery to a first viewer in a first seat and a second viewer in a second seat comprising:

providing an armrest between the first seat and the second seat;

providing fluid nozzles, on an upwardly projected portion of the end of the armrest, coupled to a fluid delivery system, wherein the fluid nozzles include a first nozzle to direct fluid to the first viewer and a second nozzle to direct fluid to a second viewer; and communicating commands from a programmable controller, wherein the commands are associated with events on a movie timeline, adapted to actuate the fluid delivery system to deliver fluids to the nozzles.

21. The method of claim 20, wherein the programmable controller converts digital data to voltage signals to the fluid delivery system.

22. The method of claim 20, wherein the nozzles include one or more water nozzle(s), scent nozzle(s), and air nozzle(s).

23. The method of claim 20, further comprising receiving commands at the start and the end of an event to activate and de-activate valves to spray air, scent, and/or water to the viewer in accordance with the movie timeline.

* * * * *